US009969054B2

(12) United States Patent
Chou et al.

(10) Patent No.: US 9,969,054 B2
(45) Date of Patent: May 15, 2018

(54) GRINDING TOOL AND METHOD OF MANUFACTURING THE SAME

(71) Applicant: KINIK COMPANY, Taipei (TW)

(72) Inventors: Jui-Lin Chou, New Taipei (TW); Chia-Feng Chiu, New Taipei (TW); Wen-Jen Liao, New Taipei (TW); Xue-Shen Su, New Taipei (TW)

(73) Assignee: Kinik Company, Taipei (TW)

( * ) Notice: Subject to any disclaimer, the term of this patent is extended or adjusted under 35 U.S.C. 154(b) by 50 days.

(21) Appl. No.: 15/133,317

(22) Filed: Apr. 20, 2016

(65) Prior Publication Data

US 2016/0303705 A1 Oct. 20, 2016

(30) Foreign Application Priority Data

Apr. 20, 2015 (TW) ..... 104112579 A

(51) Int. Cl.

| | |
|---|---|
| ***B24D 18/00*** | (2006.01) |
| ***B24D 7/06*** | (2006.01) |
| ***B24D 3/00*** | (2006.01) |
| ***B24B 37/26*** | (2012.01) |
| ***B24B 53/017*** | (2012.01) |
| ***B24D 9/08*** | (2006.01) |

(52) U.S. Cl.

CPC ..... *B24B 53/017* (2013.01); *B24B 37/26* (2013.01); *B24D 3/00* (2013.01); *B24D 7/06* (2013.01); *B24D 7/066* (2013.01); *B24D 9/08* (2013.01); *B24D 18/00* (2013.01); *B24D 18/0018* (2013.01)

(58) Field of Classification Search

CPC ..... B24B 37/26; B24B 53/017; B24D 3/00; B24D 7/06; B24D 7/066; B24D 9/08; B24D 11/00; B24D 18/00; B24D 18/0018

USPC ..... 451/443, 530, 533, 539, 548

See application file for complete search history.

(56) References Cited

U.S. PATENT DOCUMENTS

| | | | | |
|---|---|---|---|---|
| 3,464,166 A * | 9/1969 | Bouvier | B24D 13/14 | 451/548 |
| 5,209,760 A * | 5/1993 | Wiand | B24B 7/22 | 51/293 |
| 5,514,027 A * | 5/1996 | Pearlman | B24B 7/186 | 125/38 |
| 5,567,503 A * | 10/1996 | Sexton | B24B 7/22 | 428/137 |

(Continued)

FOREIGN PATENT DOCUMENTS

| | | |
|---|---|---|
| TW | 417169 I | 12/2010 |
| TW | 481093 M | 7/2014 |

OTHER PUBLICATIONS

Office Action dated Feb. 8, 2017 in co-pending TW Appl. No. 104112579.

*Primary Examiner* — Eileen Morgan

(74) *Attorney, Agent, or Firm* — Daniel A. Tallitsch; Baker McKenzie LLP

(57) ABSTRACT

A grinding tool includes a substrate having a working surface, and a plurality of abrasive particles distributed over the working surface and protruding outward from the working surface, wherein at least some of the abrasive particles are machined to form abrasive particles respectively having an obliquely truncated pyramid shape. Some embodiments described herein also include a method of manufacturing the grinding tool.

20 Claims, 8 Drawing Sheets

(56) References Cited

U.S. PATENT DOCUMENTS

| | | | | |
|---|---|---|---|---|
| 5,888,119 | A * | 3/1999 | Christianson | B24B 13/01 451/36 |
| 5,958,794 | A * | 9/1999 | Bruxvoort | B24B 7/228 216/88 |
| 6,312,484 | B1 * | 11/2001 | Chou | B24D 3/002 51/295 |
| 6,634,929 | B1 * | 10/2003 | Visser | B24B 7/241 451/28 |
| 2002/0019199 | A1 * | 2/2002 | Goers | B24B 7/241 451/41 |
| 2002/0026752 | A1 * | 3/2002 | Culler | B24D 3/28 51/298 |
| 2004/0003895 | A1 * | 1/2004 | Amano | B24B 37/245 156/345.12 |
| 2004/0235406 | A1 * | 11/2004 | Duescher | C09K 3/1436 451/527 |
| 2007/0254560 | A1 * | 11/2007 | Woo | B24D 11/001 451/41 |
| 2008/0026583 | A1 * | 1/2008 | Hardy | B24B 37/044 438/693 |
| 2009/0017276 | A1 * | 1/2009 | Hoglund | B24B 37/245 428/206 |
| 2009/0017727 | A1 * | 1/2009 | Pribyl | B24D 3/28 451/28 |
| 2009/0163127 | A1 * | 6/2009 | David | B24D 11/001 451/486 |
| 2012/0071074 | A1 * | 3/2012 | Masuzaki | B24D 3/00 451/540 |
| 2016/0263722 | A1 * | 9/2016 | Nelson | B24D 11/001 |
| 2016/0271752 | A1 * | 9/2016 | Axinte | B24D 3/00 |

* cited by examiner

GRINDING TOOL AND METHOD OF MANUFACTURING THE SAME

CROSS-REFERENCE TO RELATED APPLICATION(S)

This application claims priority to Taiwan Patent Application No. 104112579 filed on Apr. 20, 2015, the disclosure of which is incorporated herein by reference.

BACKGROUND

1. Field of the Invention

The present invention relates to grinding tools used in chemical mechanical polishing techniques.

2. Description of the Related Art

Grinding and/or polishing techniques are generally applied to create a desirable surface roughness or planarity on a rigid part, such as metal, ceramic or glass parts, or semiconductor wafers. To this purpose, the grinding and/or polishing techniques use tools having abrasive elements that can wear the hard surface.

A well known polishing technique is the chemical mechanical polishing (CMP) technique employed in semiconductor fabrication processes. CMP uses corrosive chemical slurry in conjunction with a polishing pad to remove undesired residues and planarize a wafer surface, which can be made of ceramic, silicon, glass, sapphire or metal. CMP can be typically conducted multiple times to planarize wafers. For example, the fabrication process of semiconductor wafers having 28 nm-wide features may require up to 30 CMP steps. After the polishing pad is used over a period of time, the grinding action of the polishing pad may diminish. Accordingly, an additional grinding tool (also called "conditioner") may be typically used to coarsen the surface of the polishing pad for maintaining an optimal grinding efficiency of the polishing pad.

Conventionally, a cutting rate of the grinding tool may be improved by increasing a distribution density of the abrasive elements provided thereon. This requires increasing the quantity of abrasive elements on the grinding tool, which makes the grinding tool more expensive to manufacture.

Therefore, there is a need for a grinding tool that can have an improved cutting rate, can be fabricated in a cost-effective manner and address at least the foregoing issues.

SUMMARY

The present application describes a grinding tool and methods of manufacturing the grinding tool that can address at least the aforementioned problems. In one embodiment, the grinding tool includes a substrate having a working surface, and a plurality of abrasive particles distributed over the working surface and protruding outward from the working surface, wherein at least some of the abrasive particles are machined to form abrasive particles respectively having an obliquely truncated pyramid shape.

The method of manufacturing the grinding tool includes providing a plurality of abrasive particles and a substrate having a working surface, machining at least some of the abrasive particles to form abrasive particles respectively having an obliquely truncated pyramid shape, and distributing the machined abrasive particles over the working surface, the machined abrasive particles protruding outward from the working surface.

DETAILED DESCRIPTION OF THE EMBODIMENTS

Figure 1:
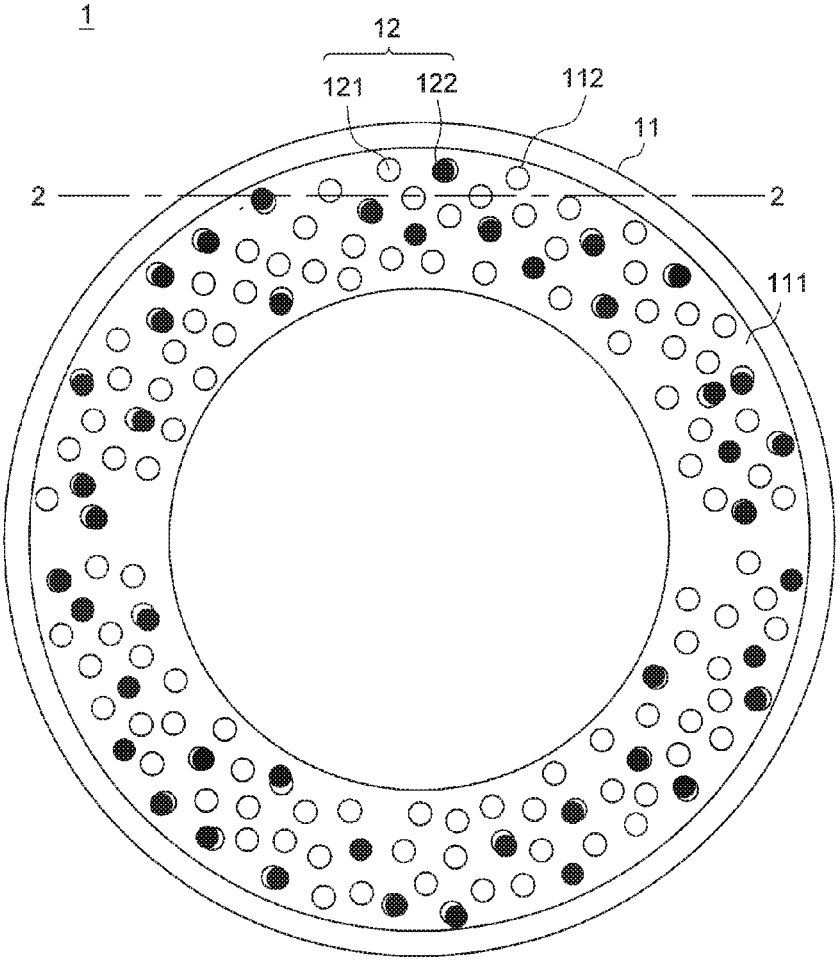
FIG. 1 is a planar view illustrating an embodiment of a grinding tool.
Figure 2:
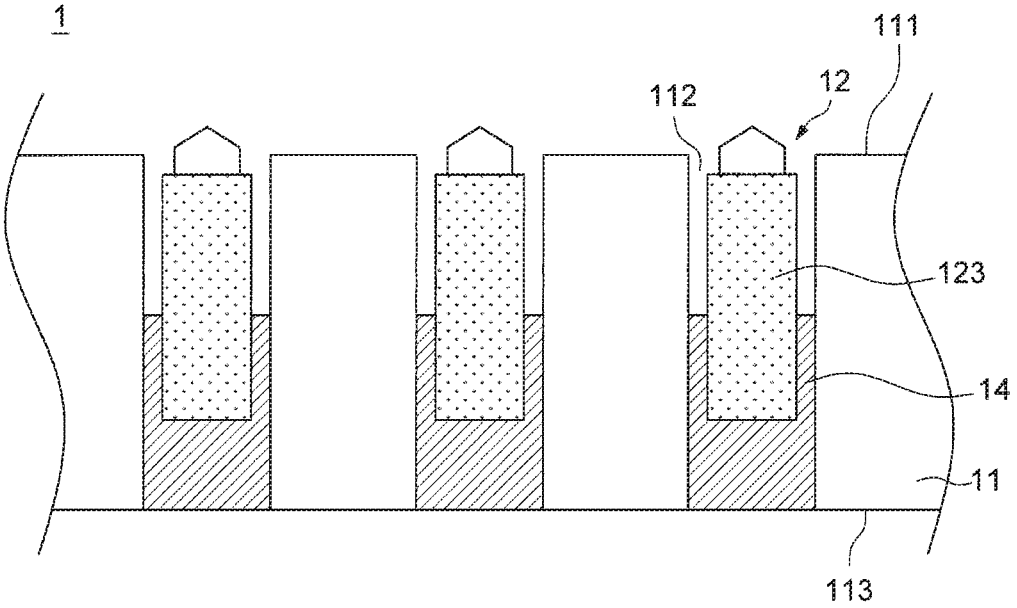
FIG. 2 is a schematic cross-sectional view taken along section plane 2 of FIG. 1 illustrating support posts affixed in holes provided in the grinding tool.

FIG. 1 is a schematic planar view illustrating an embodiment of a grinding tool 1, and FIG. 2 is a schematic cross-sectional view taken along section plane 2 shown in FIG. 1 illustrating support posts 123 affixed in holes 112 of the grinding tool 1. In one example of implementation, the grinding tool 1 can be used as a conditioner for a polishing pad in chemical mechanical polishing (CMP) processes. Referring to FIGS. 1 and 2, the grinding tool 1 can include a substrate 11 and a plurality of abrasive particles 12. The substrate 11 can have a working surface 111 and a bottom surface 113 on two opposite sides, and a plurality of holes 112 respectively opening on the working surface 111 and the bottom surface 113. The abrasive particles 12 can be respectively affixed to a plurality of support posts 123, and the support posts 123 can be respectively attached in the holes 112 of the substrate 11 via bonding layers 14. The bonding layers 14 can be exposed outward on the bottom surface 113 of the substrate 11, and the abrasive particles 12 can project outward from the working surface 111 of the substrate 11. The working surface 111 of the substrate 11 thus can be used for uniformly grinding a desirable article. Examples of suitable materials for the substrate 11 can be stainless steel, polymer or ceramic.

Exemplary techniques for attaching the abrasive particles 12 to the support posts 123 can include brazing, sintering, electroplating and the like. The support posts 123 can have cylindrical shapes, parallelepiped shapes, or any other suitable shapes. Examples of suitable materials for the support posts 123 can include metallic materials.

The abrasive particles 12 can be made of any suitable materials having high hardness. Examples of suitable materials can include diamond, cubic boron nitride, aluminum oxide, and silicon carbide. The size of the abrasive particles 12 can exemplary be 20 to 30 US mesh, i.e., a mesh screen used to filter the abrasive particles can have 20 to 30 openings per square inch.

Referring again to FIG. 1, the abrasive particles 12 of the grinding tool 1 can include a plurality of first abrasive particles 121 and a plurality of second abrasive particles 122. The first abrasive particles 121 have specifically machined surfaces, and the second abrasive particles 122 have no machined surfaces. In FIG. 1, the first abrasive particles 121 are represented as hollow circles, and the second abrasive particles 122 are represented as solid circles. The first abrasive particles 121 can be distributed over the entire working surface 111, and the second abrasive particles 122 can be dispersed among the first abrasive particles 111.

The first abrasive particles 121 can be machined with an abrasive tool to obtain a desired shape. In one embodiment, each of the first abrasive particles 121 can be machined to form an oblique truncated pyramid, i.e., the pyramid is cut by an oblique plane not parallel to the base of the pyramid. For example, each of the first abrasive particles 121 can be a right square pyramid that is obliquely truncated so as to form a bevel having a quadrilateral shape as shown in FIG. 3A, or to form a bevel having the shape of an isosceles trapezoid as shown in FIG. 4A.

Figure 3A:
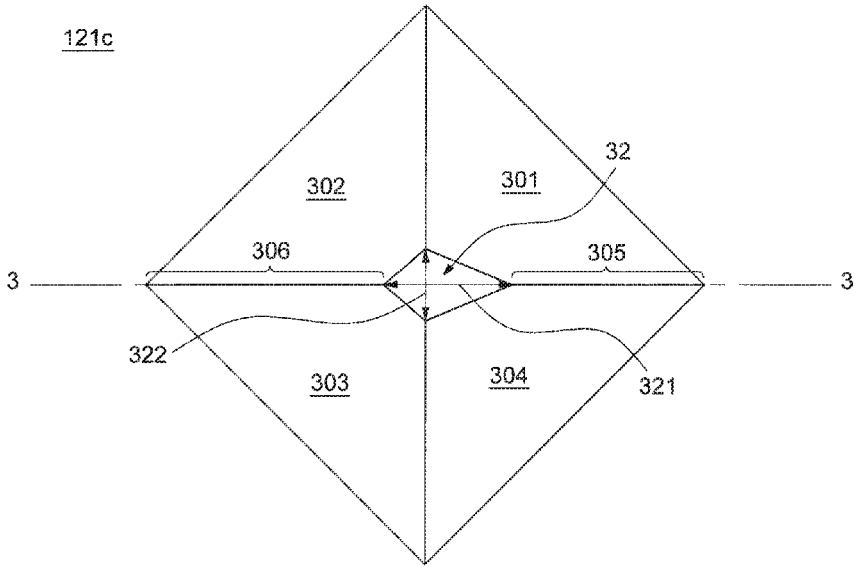
FIG. 3A is a schematic top view illustrating an abrasive particle provided as a right square pyramid obliquely truncated so as to form a bevel having a quadrilateral shape.
Figure 3B:
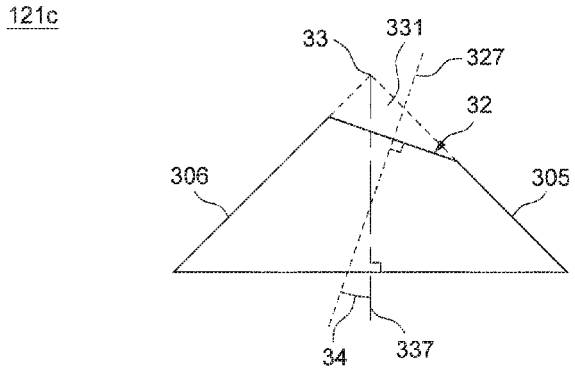
FIG. 3B is a cross-sectional view of the abrasive particle taken along section plane 3 as shown in FIG. 3A.

FIG. 3A is a schematic top view illustrating an abrasive particle 121*c* provided as a right square pyramid obliquely truncated so as to form a bevel 32 having a quadrilateral shape, and FIG. 3B is a cross-sectional view of the abrasive particle 121*c* taken along section plane 3 as shown in FIG. 3A. Referring to FIGS. 3A and 3B, the abrasive particle 121*c* can be formed from a right square pyramid including a square base and four lateral faces 301, 302, 303 and 304 that intersect with one another at a vertex 33 of the pyramid. Any pair of opposite lateral faces (e.g., lateral faces 302 and 304) can define a vertex angle between about 70 degrees and about 90 degrees, e.g., 80 degrees. The vertex angle can be defined as the angle between the respective slant heights on the two opposite lateral faces of the right square pyramid shape. Moreover, the right square pyramid can be truncated with an oblique plane to remove a top portion 331 of the pyramid including the vertex 33, thereby forming a bevel 32 having a quadrilateral shape. The shape of the bevel 32 depends on how the pyramid is truncated. In one embodiment, the quadrilateral shape of the bevel 32 can be formed by cutting the right square pyramid from one of its lateral edges (e.g., lateral edge 305). The bevel 32 thereby formed can have a first diagonal 321, and a second diagonal 322 shorter than the first diagonal 321 in length. The first diagonal 321 passes through a center point of the second diagonal 322 and is perpendicular to the second diagonal 322, i.e., the first diagonal 321 is a perpendicular bisector of the second diagonal 322. However, the second diagonal 322 is not a perpendicular bisector of the first diagonal 321. In one embodiment, the first diagonal 321 can have a length between about 0.08 cm and about 0.12 cm.

Referring to FIG. 3B, the bevel 32 can have a normal line 327 that intersects a normal line 337 to the base of the pyramid (i.e., corresponding to a horizontal plane in FIG. 3B), an acute angle 34 defined between the normal lines 327 and 337 being between about 22.5 degrees and about 32.5 degrees. In one embodiment, the acute angle 34 can be equal to about 27.5 degrees. In use, the abrasive particle 121*c* thereby formed has higher wear resistance, and can form a larger cut on a treated article (e.g., a polishing pad).

Figure 4A:
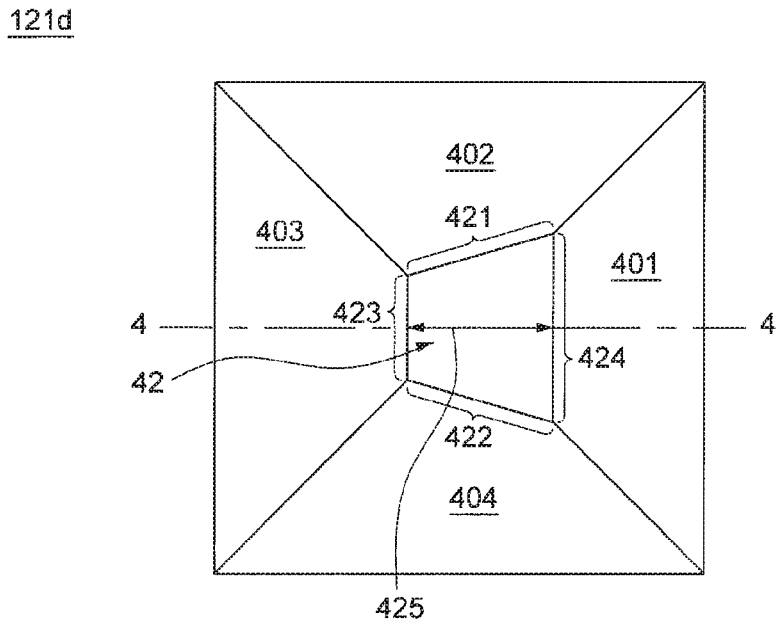
FIG. 4A is a schematic top view illustrating another abrasive particle provided as a right square pyramid obliquely truncated to form a bevel having an isosceles trapezoid shape.
Figure 4B:
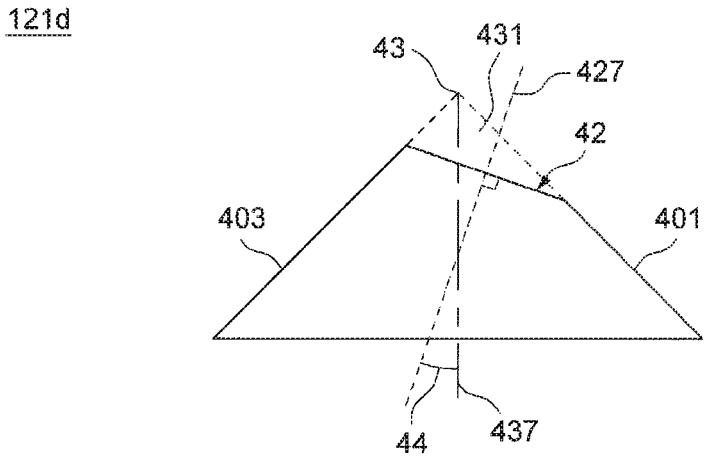
FIG. 4B is a cross-sectional view of the abrasive particle taken along section plane 4 as shown in FIG. 4A.

FIG. 4A is a schematic top view illustrating another abrasive particle 121*d* provided as a right square pyramid obliquely truncated to form a bevel 42 having an isosceles trapezoid shape, and FIG. 4B is a cross-sectional view of the abrasive particle 121*d* taken along section plane 4 as shown in FIG. 4A. Referring to FIGS. 4A and 4B, the abrasive particle 121*d* can be formed from a right square pyramid including four lateral faces 401, 402, 403 and 404. The lateral faces 401, 402, 403 and 404 may be extended to intersect an imaginary vertex 43 of the right square pyramid (as shown with phantom lines in FIG. 4B). Any pair of opposite lateral faces (e.g., lateral faces 401 and 403) can define a vertex angle between about 70 degrees and about 90 degrees, e.g., 80 degrees. The vertex angle can be defined as the angle between the respective slant heights on the two opposite lateral faces of the right square pyramid shape. Moreover, the right square pyramid can be truncated with an oblique plane to remove a top portion 431 of the pyramid including the vertex 43, thereby forming a bevel 42 having the shape of an isosceles trapezoid. In one embodiment, the isosceles trapezoid shape of the bevel 42 can be formed by cutting the right square pyramid along one of its lateral faces (e.g., lateral face 401). The bevel 42 thereby formed can have two opposite sides 421 and 422 of generally equal lengths, and two bases 423 and 424 parallel to each other. The base 424 is greater than the base 423 in length, and a distance 425 between the two bases 423 and 424 being between about 0.18 cm and about 0.22 cm.

Referring to FIG. 4B, the bevel 42 can have a normal line 427 that intersects a normal line 437 to the base of the pyramid (i.e., corresponding to a horizontal plane in FIG. 4B), an acute angle 44 defined between the normal lines 427 and 437 being between about 30 degrees and about 40 degrees. In one embodiment, the acute angle 44 can be equal to about 35 degrees. In use, the abrasive particle 121*d* thereby formed may more easily remove residues or protuberances on a treated article (e.g., a polishing pad).

Generally, the higher cutting rate, the better grinding action. Through experiments, it is observed that that the cutting rate of abrasive particles with specifically machined surfaces as described herein can be higher than conventional abrasive particles without specifically machined surfaces. Unlike conventional grinding tools having no abrasive particles with specifically machined surfaces (i.e., having only second abrasive particles 122 shown in FIG. 1), the grinding tool 1 described herein can have an improved cutting rate by incorporating first abrasive particles 121 having specifically machined surfaces and second abrasive particles 122 having no machined surfaces.

Figure 5A:
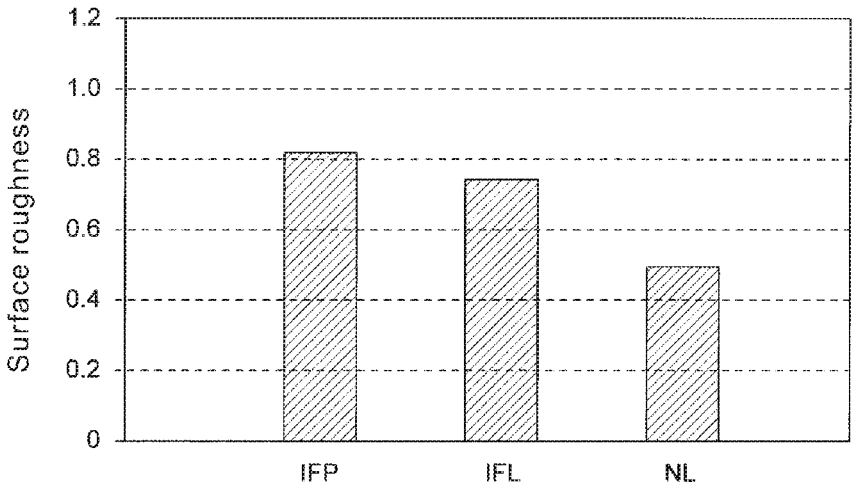
FIG. 5A is a schematic diagram comparing a surface roughness of a polishing pad respectively obtained when it is conditioned with abrasive particles having no machined surfaces and with abrasive particles having machined surfaces as shown in FIGS. 3A and 3B and FIGS. 4A and 4B.

FIG. 5A is a schematic diagram comparing a surface roughness of a polishing pad respectively obtained when it is conditioned with abrasive particles having no machined surfaces (designated as "NL"), with abrasive particles having machined surfaces as shown in FIGS. 3A and 3B (designated as "IFP"), and with abrasive particles having machined surfaces as shown in FIGS. 4A and 4B (designated as "IFL"). The higher surface roughness, the better grinding action is provided by the abrasive particles. As shown, the surface roughness obtained with samples IFP is about 0.8, the surface roughness obtained with samples IFL is about 0.75, and the surface roughness obtained with samples NL is about 0.5. These results show that the use of a grinding tool including abrasive particles with machined surfaces as described herein can advantageously provide higher surface roughness.

Figure 5B:
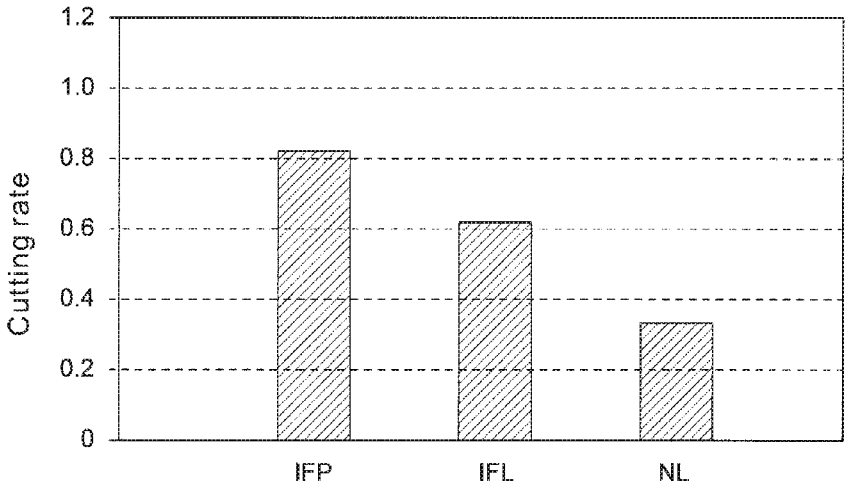
FIG. 5B is a schematic diagram comparing the cutting rates respectively exhibited by abrasive particles having no machined surfaces and abrasive particles having machined surfaces as shown in FIGS. 3A and 3B and FIGS. 4A and 4B.
Figure 6:
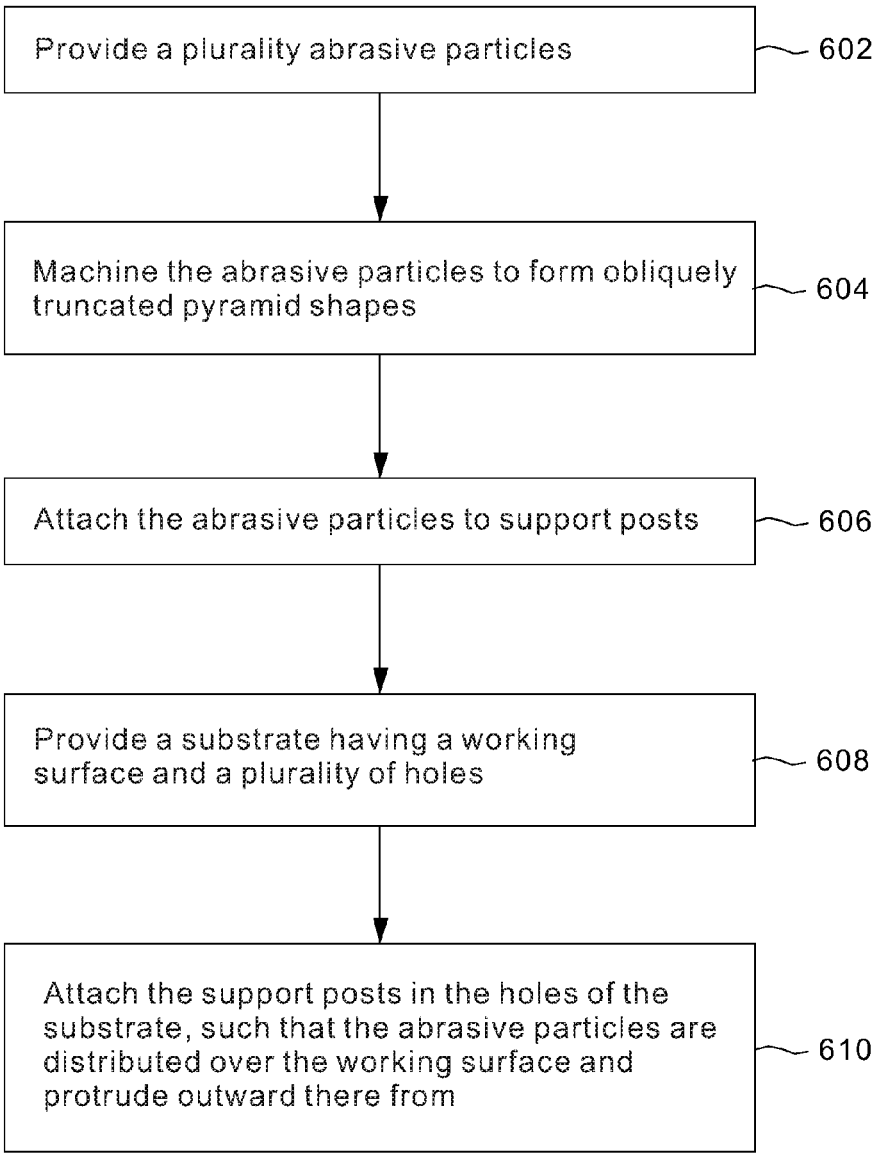
FIG. 6 is a flowchart illustrating method steps of fabricating a grinding tool.

FIG. 5B is a schematic diagram comparing the cutting rates respectively exhibited by samples NL of abrasive particles having no machined surfaces, samples IFP of abrasive particles having machined surfaces as shown in FIGS. 3A and 3B, and samples IFL of abrasive particles having machined surfaces as shown in FIGS. 4A and 4B. The cutting rate can reflect the ability of abrasive particles to cut and remove matter from a treated article (such as a polishing pad used in chemical mechanical polishing). As shown in FIG. 5B, the cutting rate of samples IFP is about 0.8, the cutting rate of samples IFL is about 0.6, and the cutting rate of samples NL is about 0.35. These results show that a grinding tool including abrasive particles with machined surfaces as described herein can advantageously have a higher cutting rate.

In conjunction with FIGS. 1-4B, FIG. 6 is a flowchart illustrating method steps of manufacturing the grinding tool 1. In step 602, a plurality of abrasive particles 12 are provided. The abrasive particles 12 can be made of materials having high hardness including, without limitation, diamond, cubic boron nitride, aluminum oxide, and silicon carbide. The size of the abrasive particles can be 20 to 30 US mesh.

In step 604, at least some of the abrasive particles 12 are machined with an abrasive tool to form the abrasive particles 121 having a truncated pyramid shape with a bevel as previously described with reference to FIGS. 3A-3B and 4A-4B.

Figure 7A:
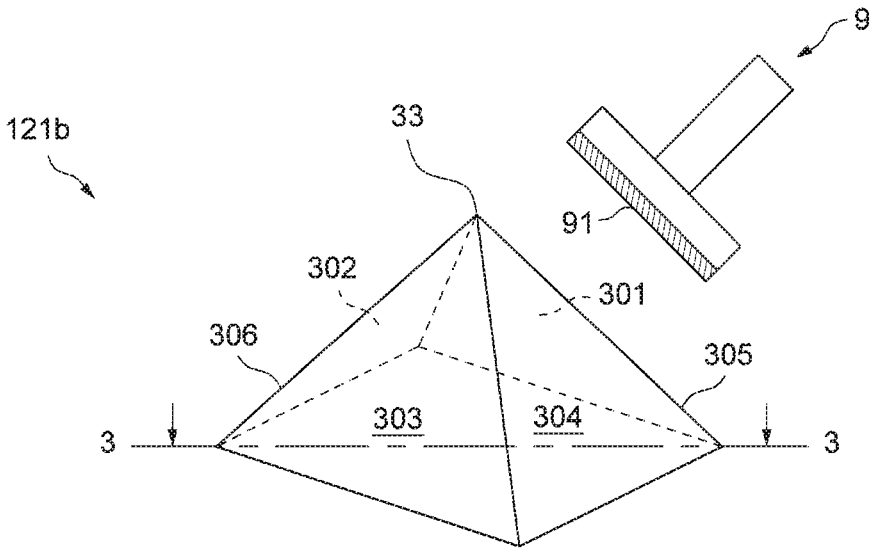
FIG. 7A is a schematic view illustrating how an abrasive particle may be machined to form the abrasive particle having the truncated pyramid shape shown in FIGS. 3A and 3B.
Figure 7B:
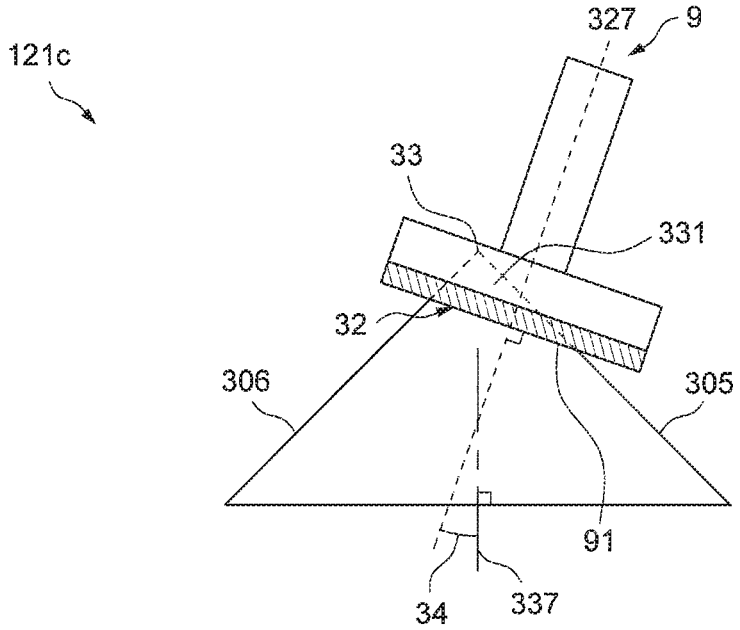
FIG. 7B is a cross-sectional view taken along section plane 3 shown in FIG. 7A.

FIG. 7A is a schematic view illustrating how an abrasive particle may be machined to form the abrasive particle 121*c* having a truncated pyramid shape shown in FIGS. 3A and 3B, and FIG. 7B is a cross-sectional view taken along section plane 3 shown in FIG. 7A. Referring to FIGS. 7A and 7B, an abrasive particle can be machined with an abrasive tool 9 to form a right square pyramid 121*b* having a vertex 33. The right square pyramid 121*b* then can be further machined to remove a top portion 331 including the vertex 33, thereby forming the abrasive particle 121*c* having the bevel 32.

For forming the bevel 32, the grinding surface 91 of the abrasive tool 9 can be exemplary positioned such that a normal line 327 to the grinding surface 91 is located in a plane defined by the lateral edge 305 (i.e., contiguous to the lateral faces 301 and 304) and the lateral edge 306 (i.e., contiguous to the lateral faces 302 and 303). Moreover, the grinding surface 91 can be titled an angle relative to the lateral edge 305, which may be defined by the acute angle 34 between the normal line 327 to the grinding surface 91 and the normal line 337 to the base of the pyramid. The acute angle 34 can be between about 22.5 degrees and about 32.5 degrees, for example about 27.5 degrees. The bevel 32 thereby formed can have a quadrilateral shape such as shown in FIG. 3A. More specifically, with reference to FIG. 3A, the formed bevel 32 can have a first diagonal 321 and a second diagonal 322, the second diagonal 322 being shorter than the first diagonal 321 in length, and the first diagonal 321 being the perpendicular bisector of the second diagonal 322. In one embodiment, the first diagonal 321 can exemplary have a length between about 0.08 cm and about 0.12 cm.

Figure 8A:
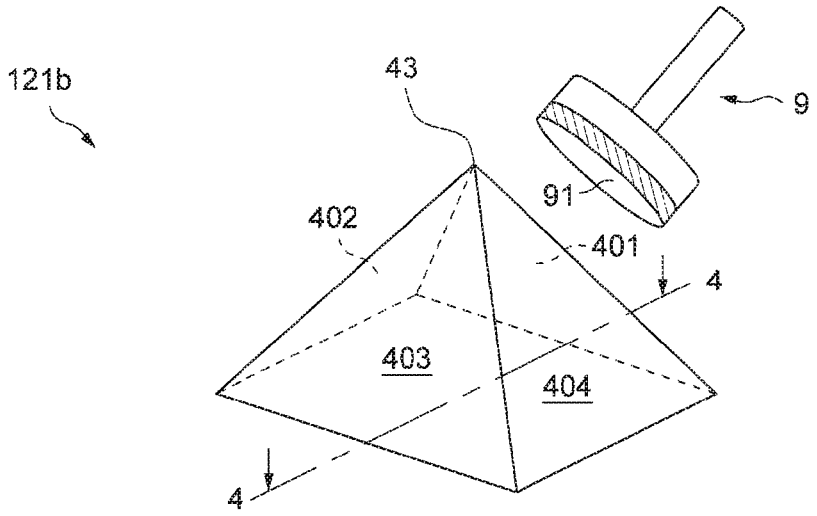
FIG. 8A is a schematic view illustrating how an abrasive particle may be machined to form the abrasive particle having the truncated pyramid shape shown in FIGS. 4A and 4B.
Figure 8B:
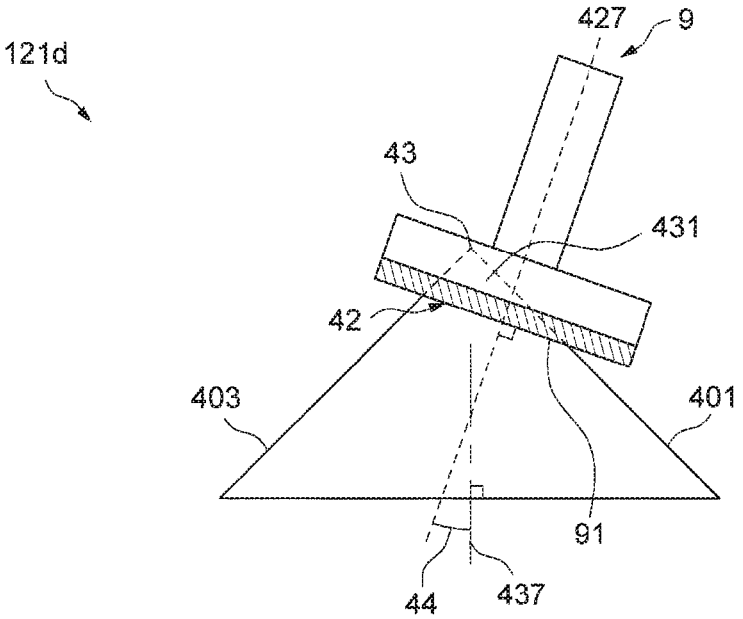
FIG. 8B is a cross-sectional view taken along section plane 4 shown in FIG. 8A.

FIG. 8A is a schematic view illustrating how an abrasive particle may be machined to form the abrasive particle 121*d* having the truncated pyramid shape shown in FIGS. 4A and 4B, and FIG. 8B is a cross-sectional view taken along section plane 4 shown in FIG. 8A. Referring to FIGS. 4A and 4B, an abrasive particle can be machined with an abrasive tool 9 to form a right square pyramid 121*b* having a vertex 43. The right square pyramid 121*b* then can be further machined to remove a top portion 431 including the vertex 43, thereby forming the abrasive particle 121*d* having the bevel 42.

For forming the bevel 42, the abrasive tool 9 can be first positioned such that the grinding surface 91 is parallel to the lateral face 401. The grinding surface 91 then can be tilted an angle from this parallel position, with the normal line 427 to the grinding surface 91 remaining in a same plane perpendicular to the base of the pyramid 121*b*. The tilt angle can be defined by the acute angle 44 between the normal line 427 to the grinding surface 91 and the normal line 437 to the base of the pyramid. The acute angle 44 can be between about 30 degrees and about 40 degrees, for example about 35 degrees. The bevel 42 thereby formed can have an isosceles trapezoid shape such as shown in FIG. 4A. For example, the isosceles trapezoid shape of the bevel 42 can have a distance between the two bases 423 and 424 that is between about 0.18 cm and about 0.22 cm, and the acute angle 44 can be equal to about 35 degrees.

Referring again to FIGS. 2 and 6, in step 606, the abrasive particles 12 (including the particles 121 and 122) can be respectively attached to the support posts 123 by brazing, sintering or electroplating.

In step 608, a substrate 11 having a working surface 111 is provided. The substrate 11 can include a plurality of holes 112 opened on the working surface 111.

In step 610, the support posts 123 can be respectively attached in the holes 112 of the substrate 11 with the abrasive particles 12 distributed over the working surfaces 111 and protruding outward. In one embodiment, the support posts 123 can be respectively attached in the holes 112 of the substrate 11 via bonding layers 14.

Advantages of the grinding tool described herein include the ability to provide abrasive particles with machined surfaces that can improve the cutting rate of the grinding tool.

Realizations of the grinding tool and its manufacture process have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A grinding tool comprising:

a substrate having a working surface; and a plurality of abrasive particles distributed over the working surface and protruding outward from the working surface, wherein at least some of the abrasive particles are machined abrasive particles respectively having an obliquely truncated pyramid shape, the obliquely truncated pyramid shape being a right square pyramid truncated to form a bevel having a quadrilateral shape, the quadrilateral shape having a first diagonal and a second diagonal, the second diagonal being shorter than the first diagonal, the first diagonal being a perpendicular bisector of the second diagonal and having a length between about 0.08 cm and about 0.12 cm, and a first normal line to the bevel and a second normal line to a base of the pyramid shape defining an angle between about 22.5 degrees and about 32.5 degrees.

2. The grinding tool according to claim 1, wherein the angle between the first normal line and the second normal line is equal to about 27.5 degrees.

3. The grinding tool according to claim 1, wherein the abrasive particles are respectively attached to a plurality of support posts, the substrate includes a plurality of holes, and the support posts are respectively attached in the holes.

4. The grinding tool according to claim 3, wherein the abrasive particles are respectively attached to the support posts by brazing, sintering or electroplating.

5. The grinding tool according to claim 1, wherein the abrasive particles are made of diamond, cubic boron nitride, aluminum oxide or silicon carbide.

6. The grinding tool according to claim 1, wherein the substrate is made of stainless steel.

7. A method of manufacturing a grinding tool, comprising:

providing a plurality of abrasive particles and a substrate having a working surface;

machining at least some of the abrasive particles to form abrasive particles respectively having an obliquely truncated pyramid shape, wherein the obliquely truncated pyramid shape is a right square pyramid truncated to form a bevel having a quadrilateral shape, the quadrilateral shape having a first diagonal and a second diagonal, the second diagonal being shorter than the first diagonal, the first diagonal being a perpendicular bisector of the second diagonal and having a length between about 0.08 cm and about 0.12 cm, and a first normal line to the bevel and a second normal line to a base of the pyramid shape defining an angle between about 22.5 degrees and about 32.5 degrees; and distributing the machined abrasive particles over the working surface, the machined abrasive particles protruding outward from the working surface.

8. The method according to claim 7, wherein the angle between the first normal line and the second normal line is equal to about 27.5 degrees.

9. The method according to claim 7, wherein the machined abrasive particles are respectively attached to a plurality of support posts, the substrate includes a plurality of holes, and the support posts are respectively attached in the holes.

10. The method according to claim 9, wherein the machined abrasive particles are respectively attached to the support posts by brazing, sintering or electroplating.

11. The method according to claim 7, wherein the abrasive particles are made of diamond, cubic boron nitride, aluminum oxide or silicon carbide.

12. The method according to claim 7, wherein the substrate is made of stainless steel.

13. A grinding tool comprising:

a substrate having a working surface; and a plurality of abrasive particles distributed over the working surface and protruding outward from the working surface, wherein at least some of the abrasive particles are machined abrasive particles respectively having an obliquely truncated pyramid shape, the obliquely truncated pyramid shape being a right square pyramid truncated to form a bevel having an isosceles trapezoid shape, the isosceles trapezoid shape having two bases of different lengths parallel to each other, a distance between the two bases being between about 0.18 cm and about 0.22 cm, and a first normal line to the bevel and a second normal line to a base of the pyramid shape defining an angle between about 30 degrees and about 40 degrees.

14. The grinding tool according to claim 13, wherein the angle between the first normal line and the second normal line is equal to about 35 degrees.

15. The grinding tool according to claim 13, wherein the abrasive particles are made of diamond, cubic boron nitride, aluminum oxide or silicon carbide.

16. The grinding tool according to claim 13, wherein the machined abrasive particles are respectively attached to a plurality of support posts, the substrate includes a plurality of holes, and the support posts are respectively attached in the holes via bonding layers.

17. A method of manufacturing a grinding tool, comprising:

providing a plurality of abrasive particles and a substrate having a working surface;

machining at least some of the abrasive particles to form abrasive particles respectively having an obliquely truncated pyramid shape, wherein the obliquely truncated pyramid shape is a right square pyramid truncated to form a bevel having an isosceles trapezoid shape, the isosceles trapezoid shape having two bases of different lengths parallel to each other, a distance between the two bases being between about 0.18 cm and about 0.22 cm, and a first normal line to the bevel and a second normal line to a base of the pyramid shape defining an angle between about 30 degrees and about 40 degrees; and distributing the machined abrasive particles over the working surface, the machined abrasive particles protruding outward from the working surface.

18. The method according to claim 17, wherein the angle between the first normal line and the second normal line is equal to about 35 degrees.

19. The method according to claim 17, wherein the abrasive particles are made of diamond, cubic boron nitride, aluminum oxide or silicon carbide.

20. The method according to claim 17, wherein the machined abrasive particles are respectively attached to a plurality of support posts, the substrate includes a plurality of holes, and the support posts are respectively attached in the holes via bonding layers.

* * * * *